US006942406B2

(12) United States Patent
Sunada et al.

(10) Patent No.: US 6,942,406 B2
(45) Date of Patent: Sep. 13, 2005

(54) INNER PAPER GUIDE FOR MEDIA SHAPE CONTROL IN A PRINTER

(75) Inventors: Craig D. Sunada, Vancouver, WA (US); William H. Schwiebert, San Diego, CA (US); Robert D. Davis, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 52 days.

(21) Appl. No.: 10/016,746

(22) Filed: Oct. 30, 2001

(65) Prior Publication Data

US 2002/0094221 A1 Jul. 18, 2002

Related U.S. Application Data

(63) Continuation of application No. 09/400,244, filed on Sep. 21, 1999, now Pat. No. 6,312,178.

(51) Int. Cl.[7] ..... B41J 2/01

(52) U.S. Cl. ..... 400/642; 400/625; 400/645; 400/647; 400/693; 347/104; 271/264

(58) Field of Search ..... 400/642, 624, 400/625, 645, 645.5, 647, 693, 645.3, 645.4; 347/104, 105; 271/264, 123, 10.01, 117, 118

(56) References Cited

U.S. PATENT DOCUMENTS 5,177,547 A 1/1993 Kanemitsu et al.
5,192,141 A 3/1993 Chung et al.
5,940,106 A 8/1999 Walker
5,975,778 A 11/1999 Kanemitsu
6,120,201 A 9/2000 McKay et al.
6,168,270 B1 * 1/2001 Saikawa et al. ..... 347/104
6,312,178 B1 * 11/2001 Sunada et al. ..... 400/642

FOREIGN PATENT DOCUMENTS

| | | |
|---|---|---|
| EP | 0737589 | 10/1996 |
| EP | 0816107 | 1/1998 |
| JP | 10181042 | 7/1998 |

* cited by examiner

*Primary Examiner*—Ren Yan
*Assistant Examiner*—Kevin D. Williams

(57) ABSTRACT

A media handling system for handling sheets of media. The system includes a pick roller having a circumferential media-contacting surface and arranged for rotation about a roller axis to contact and pick a sheet from an input source. A drive roller rotates about a drive roller axis, with a media path extending between the pick roller and the drive roller. A first guide structure is positioned along a first longitudinal edge of the media path and providing a first media guide surface. A second guide structure is positioned along a second longitudinal edge of the media path and provides a second media guide surface. The first and second guide surfaces are positioned to constrain the movement of a media sheet in the media path between the pick roller and the drive roller, thereby alleviating trailing edge print defects.

22 Claims, 5 Drawing Sheets

INNER PAPER GUIDE FOR MEDIA SHAPE CONTROL IN A PRINTER

This is a continuation of application Ser. No. 09/400,244, filed on Sep. 21, 1999, now U.S. Pat. No. 6,312,178.

TECHNICAL FIELD OF THE INVENTION

This invention relates to media handling apparatus, and more particularly to techniques for reducing trailing edge print defects in printing devices with media-handling rollers.

BACKGROUND OF THE INVENTION

Inkjet printers typically have an input media source such as a media stack in an input tray, an output tray, a media path between the input source and the output tray, and an inkjet printing apparatus located along the media path at a print area. The printing apparatus can comprise one or more inkjet printheads with nozzle arrays which emit droplets of ink onto the print media at the print area A media handling apparatus is provided to pick the input media from the input source, feed the picked medium along the media path to the print area, and eject the picked medium onto the output tray after printing operations on the medium are completed.

In a typical sheet-fed printer using print media in sheet form, such as paper, a pick roller is employed to pick the top sheet of print media from the input tray and advance the picked sheet along the media path toward the printing apparatus. This is illustrated in the diagrammatic view of FIG. 1, wherein the pick roller 10 with associated pinch roller 13 has picked the sheet 12 from an input source (not shown), and pulled the sheet around the input guide 15 with curved guide surface ISA. The sheet handling apparatus further typically includes a feed or drive roller 14 and a forward pinch roller 16 which create a nip into which the leading edge of the picked sheet is fed by the pick roller along guide 18. The print zone at which printing operations are conducted is typically located on the media path just downstream of the pinch roller 16. Stresses are applied to the picked sheet at the print zone for media shape control and wet cockle control.

A problem arises in that the trailing edge 12A of the picked sheet is unconstrained after leaving the pick roller. Because of the stresses applied to the picked sheet in the print zone, the unconstrained shape of the sheet after leaving the pick roller is significantly rotated about the forward pinch roller 16. This is illustrated in FIG. 1, in which the constrained state prior to leaving the pick roller 10 and pinch roller 13 is indicated as sheet 12 with trailing edge 12A, and the unconstrained state is indicated as sheet 12' with trailing edge 12A'. This results in a rapid print medium shape change in stiff media that can cause an effective overfeed as seen by the print head just downstream of the nip between the drive roller and pinch roller. The effective overfeed causes a print defect, known as a "bottom of form" (BOF) print defect. This print defect is often quite visible on images printed on premium photo paper, for example.

Another cause of print defects for media handling apparatus incorporating separate roller wheels instead of solid rollers, is that, as the print medium is compressed under pinch rollers, energy is stored in the medium by deforming the print medium-around the rollers. This is illustrated in the cross-section view of FIG. 2, taken transversely to the media path. Here the pick roller structure and the pinch roller structure is defined by three spaced pick roller wheel/pinch wheel pairs, 10A/13A, 10B/13B and 10C/13C. The deformation of the medium 12 in the regions between the wheel pairs is illustrated in exaggerated form in FIG. 2. This deformation can cause overfeeding, especially on stiff medias, when the trailing edge of the medium leaves the nip between the drive and pinch rollers.

These print defects will generally be described as "trailing edge" print defects, i.e. those print defects occurring when the trailing edge of the print media passes some point, e.g. a pinch point or the pick roller.

It would therefor be an advantage to provide a technique to minimize or eliminate trailing edge print defects in printing systems using media handling apparatus with one or more rollers.

SUMMARY OF THE INVENTION

In accordance with an aspect of the invention, a media handling system is described for handling sheets of media. The system includes a pick roller having a circumferential media-contacting surface and arranged for rotation about a roller axis to contact and pick a sheet from an input source. A drive roller is arranged for rotation about a drive roller axis, with a media path extending between the pick roller and the drive roller. A first guide structure is positioned along a first longitudinal edge of the media path and providing a first media guide surface. A second guide structure is positioned along a second longitudinal edge of the media path and provides a second media guide surface. The first and second guide surfaces are positioned to constrain the movement of a media sheet in the media path between the pick roller and the drive roller, thereby alleviating trailing edge print defects.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
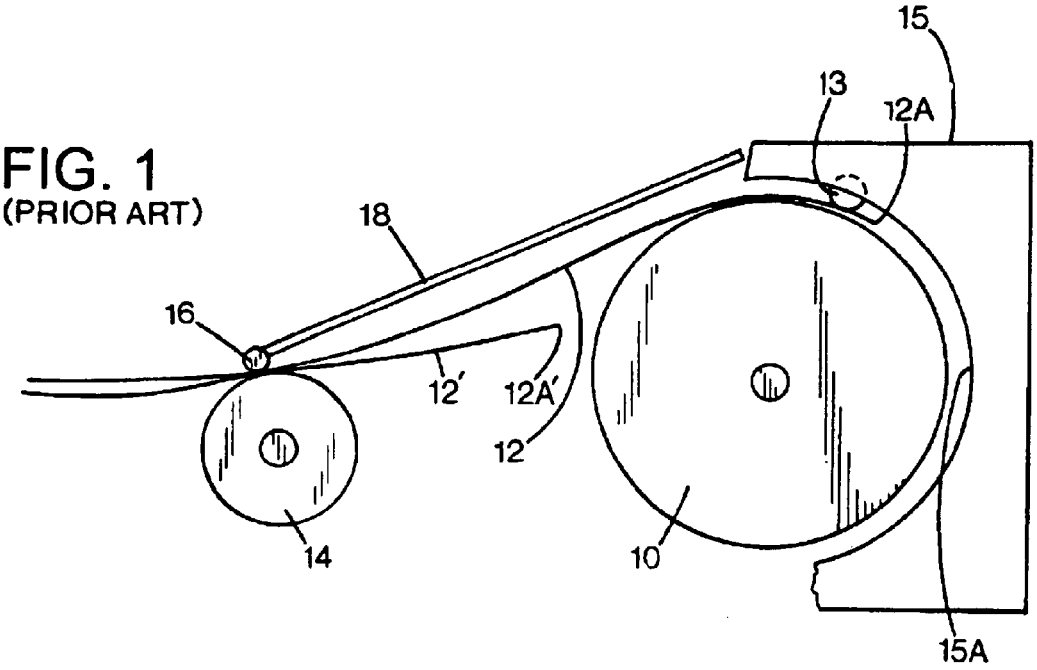
FIG. 1 (PRIOR ART)
FIG. 1 is a diagrammatic side view of a paper handling apparatus in which the trailing edge of the picked sheet is unconstrained after leaving the pick roller.
Figure 2:
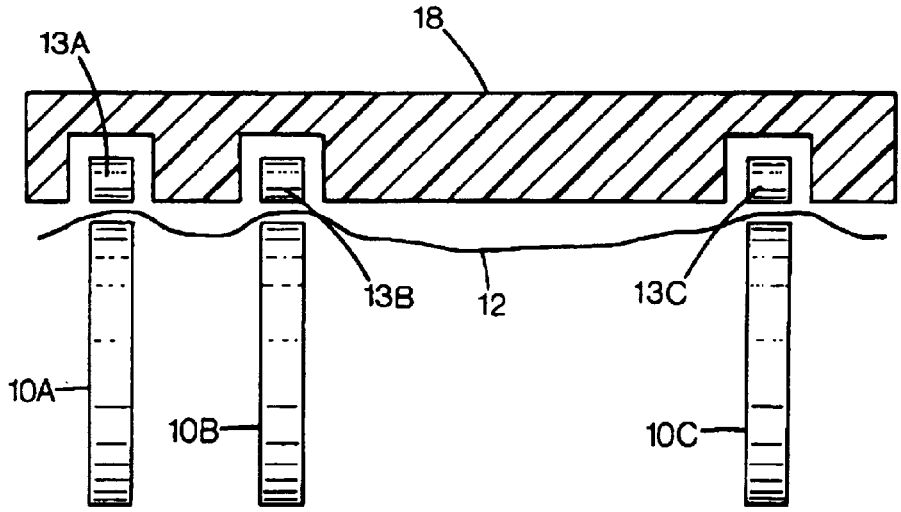
FIG. 2 (PRIOR ART)
FIG. 2 is a cross-sectional view taken transversely with respect to the media path, of a system using separated pick/pinch wheel pairs, illustrating the media deformation due to energy storage in the print medium.
Figure 3:
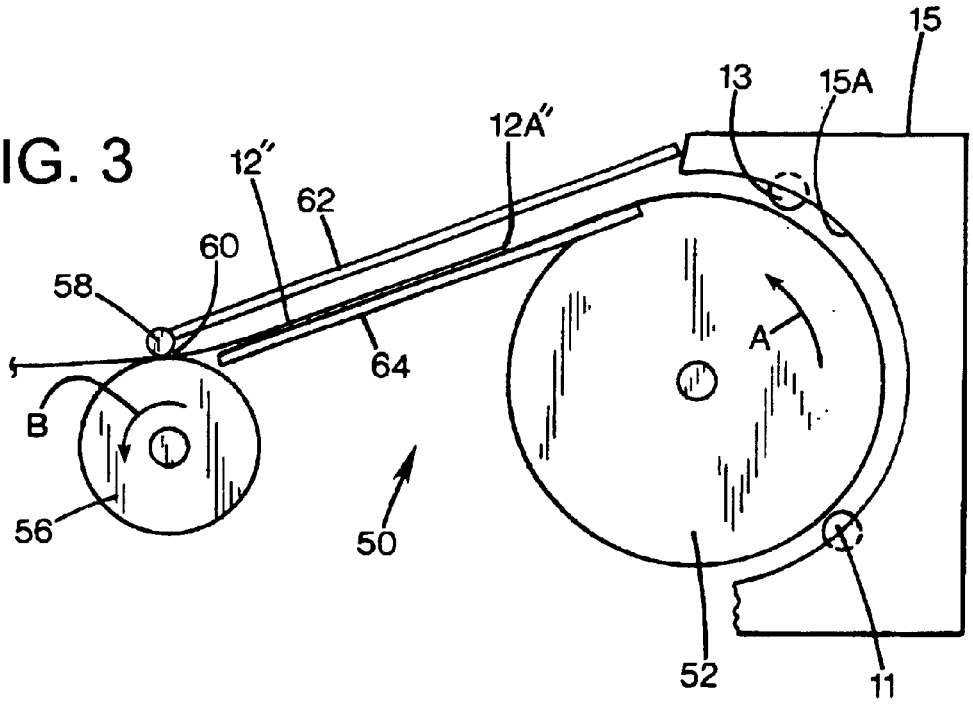
FIG. 3 is a diagrammatic side view of a print media handling apparatus in which the trailing edge of the picked sheet is constrained between two media guides after leaving the pick roller.

One aspect of the invention is illustrated in FIG. 3. Here a sheet handling system 50 is illustrated, wherein a pick roller 52 is driven in a counterclockwise (CCW) direction as indicated by arrow A to pick a sheet of a medium such as paper, transparency or the like from an input source (not shown in FIG. 3), and transport the sheet into a media path. The system further includes a drive roller 56 and a pinch roller 58, positioned so as to create a nip 60 between adjacent surfaces of the respective rollers 56, 58. The drive roller 56 is driven in a CCW direction as indicated by arrow B. The media path passes through the nip 60, wherein the picked sheet is passed from the pick roller into the nip 60, and then is driven by the drive roller along a further portion of the media path. Typically a print area is provided just downstream of the pinch roller 58, where printing operations are conducted.

In accordance with an aspect of the invention illustrated in FIG. 3, the media path between the pick roller and the drive roller is defined by an upper guide surface 62 and a lower guide surface 64. The lower guide surface constrains the movement of the trailing edge 12A" of the sheet 12" resulting in the constrained sheet shape illustrated in FIG. 3. This prevents rotation of the paper about the front pinch roller 58, as would otherwise occur in the absence of a lower guide surface.

In exemplary embodiments, the spacing between the upper guide surface 62 and the lower guide surface 64 is increased from the media entrance location adjacent the pick roller to the media exit location adjacent the drive roller, thus providing a tapered media path between the guide. The spacing distance between them will depend on the particular system and media requirements; a typical range is from 0.5 mm to 5 mm. In an exemplary embodiment for addressing BOF print defects, the spacing between the upper and lower guide surfaces is from 2.9 mm at the media entrance location to 3.6 mm at the media exit location adjacent the drive roller.

Figure 4:
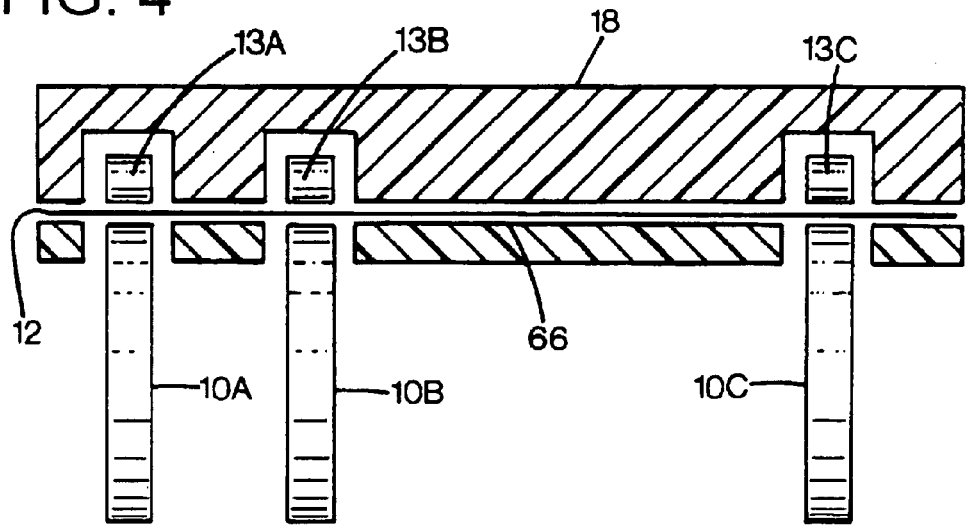
FIG. 4 is a cross-sectional view taken transversely with respect to the media path of a print media handling apparatus in which the medium is constrained between the nips of the drive roller wheels and corresponding pinch roller wheels.

FIG. 4 illustrates another aspect of the invention, wherein a lower media guide surface 66 is positioned below the upper guide surface 18 and below the nips of the pick wheel/pinch roller wheel pairs. The lower guide surface 66 supports the print medium 12 between pinch roller wheel positions, reducing the energy stored in the medium due to compression at the nips. The lower guide surface 66 also facilitates backing the print media up in a duplexing operation. For this aspect, it is desirable that the spacing between the upper guide surface and the lower guide surface at the nip between the pick roller wheels and pinch rollers be relatively small, e.g. in the range 0.5 mm to 2 mm. The closer the spacing, the more tightly is controlled the deformation of the print media when engaged between the nip. The spacing can then be gradually increased to provide a taper between the two guide surfaces. For example, the spacing at the media exit point adjacent the drive roller can be on the order of 2.5 mm to 5 mm.

Either aspect of the invention, or both aspects, as illustrated in FIGS. 3 and 4 can be employed in apparatus using sheet feeding systems. For example, an inner or lower guide surface can be implemented to address only the BOF print defect, wherein the guide surface is not required to extend between nips between pick roller wheels and pinch roller wheels. Another alternative is to provide an inner surface to support the print media at the nips between pick roller wheels and pinch roller wheels, as shown in FIG. 4, without requiring the inner guide surface to extend to the drive roller to address BOF defects. A further alternate embodiment is to address both types of print defects, and this is illustrated in FIGS. 5–7.

Figure 5:
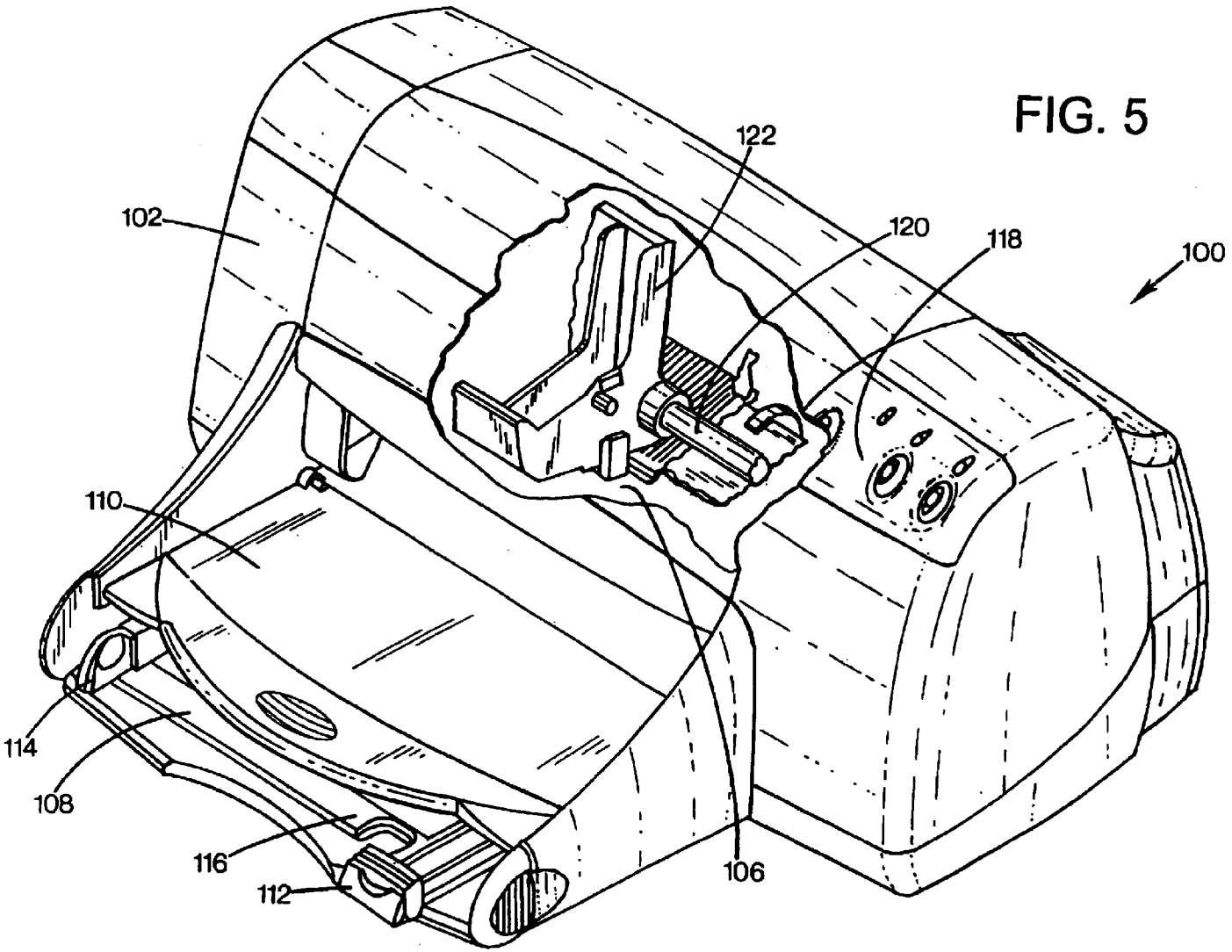
FIG. 5 is a diagrammatic side view of an inkjet printer, showing the media path through the printer.
Figure 6:
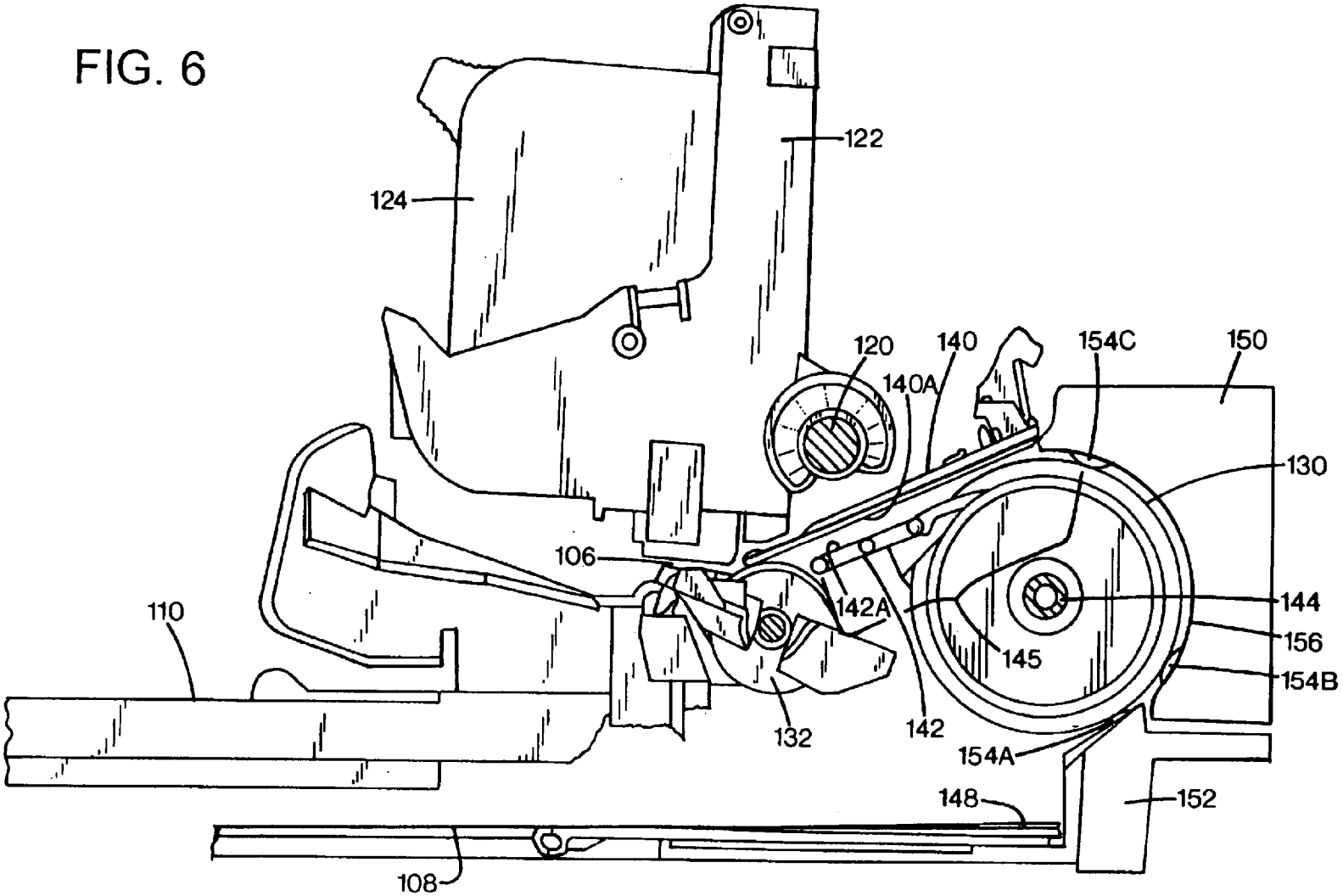
FIG. 6 is a simplified, partially-broken-away isometric view of the printer of FIG. 5.
Figure 7:
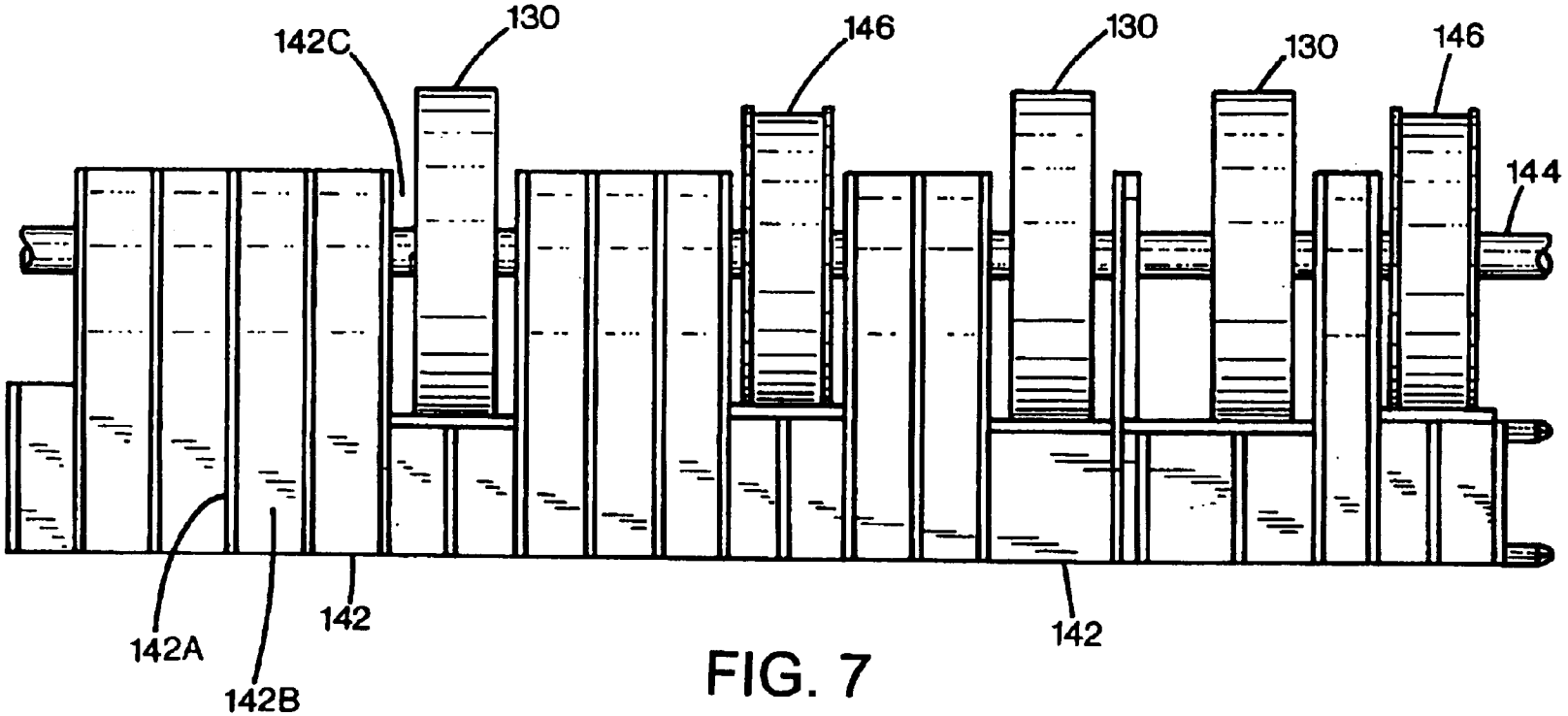
FIG. 7 is a top view of the inner media guide of the printer of FIG. 5.

FIGS. 5–7 depict in simplified form an inkjet printer 100 employing this invention. While it is apparent that the printing device components may vary from model to model, the inkjet printer 100 includes a frame or chassis surrounded by a housing, casing or enclosure 102, typically made of a plastic material. Sheets of print media are fed through a print zone 106 by a print media handling system. The print media may be any type of suitable material, such as paper, cardstock, transparencies, photographic paper, fabric, mylar, metalized media, and the like, but for convenience, the illustrated embodiment is described using paper as the print medium.

The print media handling system has an input supply feed tray 108 for storing sheets of print media before printing. A pick roller structure 130 and a drive roller structure 132 (FIG. 6) driven by a motor and drive gear assembly (not shown) may be used to move the print media from the feed tray 108, through the print zone 106, and, after printing, onto a pair of extended output drying wing members (not shown). The wings momentarily hold a newly printed sheet of print media above any previously printed sheets still drying in an output tray 110, then retract to the sides to drop the newly printed sheet into the output tray 110. The media handling system may include a series of adjustment mechanisms for accommodating different sizes of print media, including letter, legal, A-4, envelopes, etc., such as a sliding length adjustment lever 112, a sliding width adjustment lever 114, and an envelope feed port 116.

Although not shown, it is to be understood that the media handling system may also include other items such as one or more additional print media feed trays. Additionally, the media handling system and printing device 100 may be configured to support specific printing tasks such as duplex printing and banner printing.

Printing device 100 also has a printer controller, such as a microprocessor, that receives instructions from a host device, typically a computer, such as a personal computer (not shown). Many of the printer controller functions may be performed by the host computer, including any printing device drivers resident on the host computer, by electronics on board the printer, or by interactions between the host computer and the electronics. As used herein, the term "printer controller" encompasses these functions, whether performed by the host computer, the printer, an intermediary device between the host computer and printer, or by combined interaction of such elements. The printer controller may also operate in response to user inputs provided through a key pad 118 located on the exterior of the casing 102. A monitor (not shown) coupled to the computer host may be used to display visual information to an operator, such as the printer status Or a particular program being run on the host computer. Personal computers, their input devices, such as a keyboard and/or a mouse device, and monitors are all well known to those skilled in the art.

A carriage guide rod 120 is supported by the printer chassis to slidably support an inkjet pen carriage 122 for travel back and forth across print zone 106 along a scanning axis. Carriage 122 is also propelled along guide rod 120 into a servicing region located within the interior of housing 102. A conventional carriage drive gear and motor assembly (both of which are not shown) may be coupled to drive an endless loop, which may be secured in a conventional manner to carriage 122, with the motor operating in response to control signals received from the printer controller to incrementally advance carriage 122 along guide rod 120.

The end of the input media stack held in the input tray 108 adjacent the pick roller is raised by a pressure plate 148, to bring the leading edge of the top sheet into contact with the pick roller. As the pick roller is rotated, the top sheet is drawn around the periphery of the pick roller, through the nips between the pick roller 130 and pinch rollers 154A, 154B, 154C, and contact with guide surface 156 defined by curved guide 150 and support structure 152. The pressure plate is dropped to the lowered state shown in FIG. 6 after the top sheet has been picked. The pressure plate operation per se is well known in the art.

In print zone 106, the media sheet receives ink from an inkjet cartridge, such as an ink cartridge 124; the carriage can also hold a tricolor cartridge, or three monochrome color ink cartridges, to provide color printing capabilities. The cartridges each comprise a replaceable ink cartridge system wherein each pen has a reservoir that carries the entire ink supply as the printhead reciprocates over print zone 106 along the scan axis, or can include small reservoirs for storing a supply of ink in what is known as an "off-axis" ink delivery system. It should be noted that the present invention is operable in both off-axis and on-axis systems.

Referring now to FIG. 6, the media handling system of the printer 100 includes an upper media or paper guide structure 140 providing an upper guide surface 140A, which together with a portion of the curved guide surface 156 extends along the media path portion 145 extending between the pick roller and the drive roller. A lower media or paper guide structure 142 provides a lower guide surface in accordance with the invention, constraining the movement of the picked sheet in the portion of the paper path between the pick roller and the drive roller. For static control, the guide structure 142 is formed with a plurality of spaced ribs 142A extending along the media path direction and. protruding from the structure surface 142B. The ends of the ribs provide the media contacting surfaces. The pick roller structure includes three spaced pick wheels 130 mounted on a shaft 144 for rotation. Wheels 146 are provided to assist in proper advancement of media such as envelopes through the media path. Slots 142C are formed in the guide structure 142 to allow the media contacting surface to extend between the rollers to provide support and prevent deformation of the print media in the regions between the rollers 130 and 146, as is more generally illustrated in FIG. 4. The spacing between the guide surfaces of the lower guide 142 and the upper guide surface defined in this exemplary embodiment by a portion of the curved surface 156 is preferably as small as possible for a given application. An exemplary suitable range for this spacing is between 5 mm and 2.0 mm.

The lower paper guide 142 constrains the movement of the picked sheet, holding it close to the upper guide surface, and maintains the constrained paper shape through the printing operation, until the trailing edge of the paper leaves the inner paper guide. This reduces or eliminates the trailing edge defects, as long as the lower paper guide surface effectively controls the back edge of the paper during the entire print operation at the print zone.

The lower paper guide surface can also help reduce or eliminate print defects associated with disturbances earlier in the media path, by preventing the formation of a buckle in the paper sheet between the pick roller and the drive roller which can result in overfeeds. Another advantage of the lower paper guide is that it can also help reduce paper jams caused by heavily curled media diving below the drive roller. The inner paper guide also reduces card and envelope smearing by maintaining the constrained paper shape.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A media handling system for handling sheets of media, the media handling system comprising:

a pick roller structure configured to selectively contact and pick a media sheet from an input source;

a drive roller structure spaced from the pick roller structure;

a first guide structure longitudinally extending continuously from the pick roller structure to the drive roller structure;

a second guide structure longitudinally extending between the pick roller structure and drive roller structure to define a media path between first and second guide structures, the media path defining a media entrance adjacent the pick roller structure and a media exit adjacent the drive roller structure; and wherein the media path constrains the movement of a trailing edge of the media sheet as the trailing edge leaves the pick roller structure to minimize trailing edge print defects, wherein the first and second guide structures are separated by a distance, the distance being greater at the media exit than at the media entrance wherein the distance between the first and second guide structures increases gradually from the media entrance to the media exit.

2. The media handling system of claim 1, wherein the distance between the first and second guide structures is between 0.5 mm and 5 mm.

3. The media handling system of claim 1, wherein the pick roller structure includes a plurality of spaced pick roller wheels.

4. The media handling system of claim 3, further comprising:

a plurality of pinch wheels corresponding with the plurality of pick roller wheels, each of the plurality of pinch wheels corresponding with and positioned with respect to a corresponding pick roller wheel to create a nip between the respective pick roller wheel and the pinch wheel; and wherein the second guide structure is arranged to constrain and support the media sheet at regions between the nips to reduce stress exerted on the media sheet at the nips.

5. The media handling system of claim 1, wherein the pick roller structure is configured to pick the media sheet from the input source in a first direction and to rotate the media sheet such that the media sheet exits the pick roller structure traveling in a second direction.

6. The media handling system of claim 5, wherein the first direction is opposite the second direction.

7. The media handling system of claim 5, further comprising:

an input guide corresponding with the pick roller structure to guide the media sheet at least partially around the pick roller structure.

8. The media handling system of claim 1, wherein the first and second guide structures each linearly extend between the pick roller structure and the drive roller structure.

9. The media handling system of claim 1, wherein the first and second guide structures are positioned with respect to the pick roller structure such that the media sheet exits the pick roller directly into the media path.

10. A media handling system for handling sheets of media, the media handling system comprising:

a pick roller structure configured to selectively contact and pick a media sheet from an input source;

a drive roller structure spaced from the pick roller structure;

a first guide structure longitudinally extending between the pick roller structure and the drive roller structure;

a second guide structure longitudinally extending between the pick roller structure and the drive roller structure spaced from the first guide structure to define a media path between first and second guide structures; and wherein the media sheet exits the pick roller in the media path, the distance between the first and second guide structures constraining the movement of a trailing edge of the media sheet as the trailing edge leaves the pick roller structure to minimize trailing edge print detects, wherein the media path forms a media entrance abutting the pick roller structure and a media exit adjacent the drive roller structure, wherein the first guide structure is spaced from the second guide structure a greater distance at the media exit than at the media entrance.

11. The media handling system of claim 10, wherein the first guide structure defines a continuous surface extending entirely between the pick roller structure and the drive roller structure for supporting the media sheet.

12. The media handling system of claim 10, wherein the second guide structure defines a continuous surface extending between the pick roller structure and the drive roller structure.

13. The media handling system of claim 10, wherein the first and second guide surfaces each linearly extend between the pick roller structure and the drive roller structure.

14. The media handling system of claim 10, wherein the pick roller structure is configured to pick the media sheet from the input source in a first direction and to rotate the media sheer such that the media sheet exits the pick roller structure traveling in a second direction.

15. The media handling system of claim 14, wherein the first direction is opposite the second direction.

16. The media handling system of claim 10, further comprising:

an input guide corresponding with the pick roller structure to guide the media sheet at least partially around the pick roller structure.

17. The media handling system of claim 10, wherein the second guide structure extends at least partially over the drive roller structure.

18. The media handling system of claim 10, wherein the pick roller structure defines an outer roller surface that interacts with the media sheet, the first guide structure defines a first guide surface that interacts with the media sheet, and the first guide surface is contiguously positioned with respect to the outer roller surface.

19. The media handling system of claim 10, wherein the first guide structure is positioned with respect to the pick roller structure to continuously support the media sheet as the media sheet exits the pick roller structure and enters the media path.

20. The media handling system of claim 10, wherein the first guide structure is spaced from the second guide structure a distance between 0.5 mm and 2.9 mm at the media entrance.

21. The media handling system of claim 10, wherein the distance between the first guide structure and the second guide structure gradually increases between the media entrance and the media exit.

22. The media handling system of claim 10, wherein the first guide structure is spaced from the second guide structure a distance between 2.5 mm and 5 mm at the media exit.

* * * * *

UNITED STATES PATENT AND TRADEMARK OFFICE

CERTIFICATE OF CORRECTION

PATENT NO. : 6,942,406 B2
APPLICATION NO. : 10/016746
DATED : September 13, 2005
INVENTOR(S) : Craig D. Sunada et al.

It is certified that error appears in the above-identified patent and that said Letters Patent is hereby corrected as shown below:

Column 1, line 32, delete "ISA" and insert therefor --15A--

Column 2, line 9, delete "therefor" and insert --therefore--

Column 4, line 39, delete "on board" and insert therefor --onboard--

Column 5, line 31, after "and" and before "protruding" delete --.--

Column 8, Claim 14, line 1, delete "sheer" and insert therefor --sheet--

Column 7, Claim 10, line 17, delete "detects" and insert therefor --defects--

Signed and Sealed this

Nineteenth Day of December, 2006

JON W. DUDAS
*Director of the United States Patent and Trademark Office*